United States Patent [19]

Tsai

[11] Patent Number: 4,688,339

[45] Date of Patent: Aug. 25, 1987

[54] NO LEAK STEAM IRON

[76] Inventor: Hui-Fang Tsai, 7F,No.431-1,Sec.6,Chungshan N. Rd., Taipei, Taiwan

[21] Appl. No.: 934,266

[22] Filed: Nov. 24, 1986

[51] Int. Cl.[4] ..... D06F 75/14; D06F 75/28; D06F 75/34; D06F 75/40

[52] U.S. Cl. ..... 38/77.7; 38/77.82; 38/77.83; 38/92; 38/142; 219/247

[58] Field of Search ..... 38/77.8, 77.82, 85, 38/92, 142, 88, 77.5, 77.7, 77.83; 219/247, 271

[56] References Cited

U.S. PATENT DOCUMENTS 4,077,143 3/1978 Walker et al. ..... 38/77.83
4,125,953 11/1978 Colombo ..... 38/77.7

FOREIGN PATENT DOCUMENTS 2926508 1/1981 Fed. Rep. of Germany ..... 38/77.7
60-68899 4/1985 Japan ..... 38/77.83

*Primary Examiner*—Werner H. Schroeder
*Assistant Examiner*—Andrew M. Falk
*Attorney, Agent, or Firm*—Morton J. Rosenberg

[57] ABSTRACT

A stream iron includes a support base, a handle, a reservoir portion which has an elbow-like water entry tube for preventing water stored inside the reservoir portion from spilling out when the steam iron is tilted forward, and an ironing plate having a bi-metallic plate. A related arrangement prevents water from flowing out of the ironing plate and getting clothes being ironed wet after the steam button has been pressed if the temperature of the ironing plate is lower than a certain minimum value.

1 Claim, 7 Drawing Figures

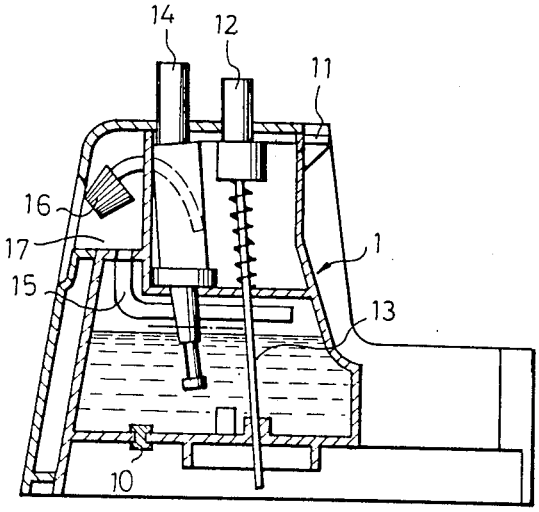
FIG. 3-A
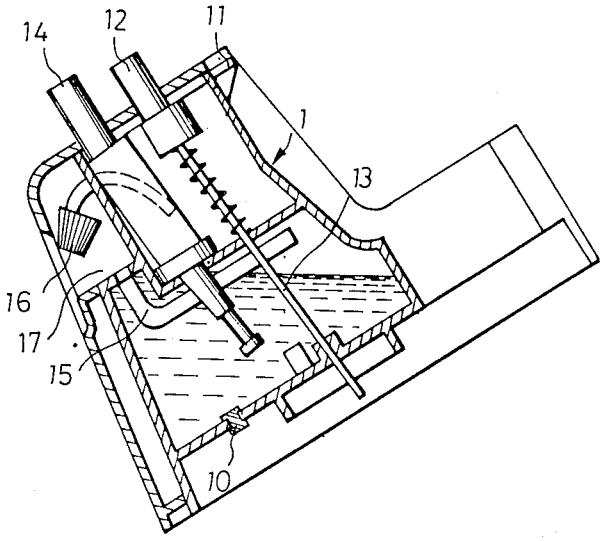
FIG. 3-B

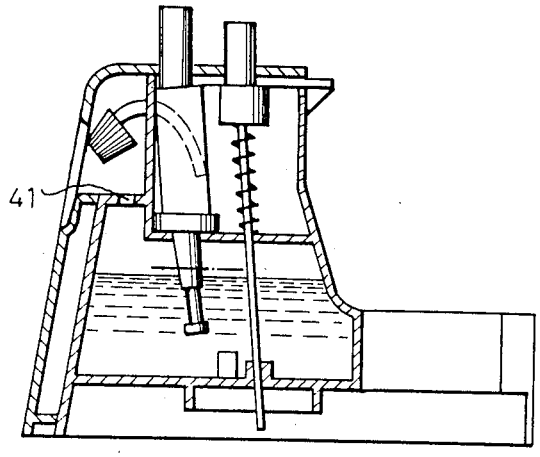
FIG. 4-A PRIOR ART
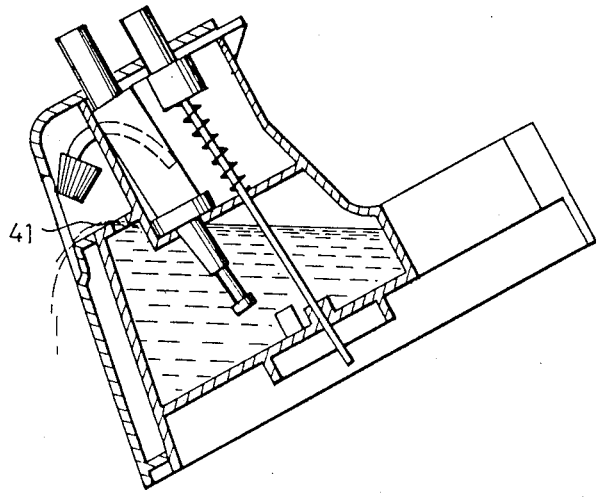
FIG. 4-B PRIOR ART

NO LEAK STEAM IRON

BACKGROUND OF THE INVENTION

This invention relates to an improved steam iron. An elbow-like water entry tube set inside the reservoir portion of the present iron is able to prevent water from spilling out by accident. In the present invention, a bi-metallic plate in conjunction with a specially designed ironing plate prevents water from leaking out and getting the clothes being ironed wet when the steam iron is not yet hot enough.

Conventional steam irons have some apparent drawbacks which are described as follows:

1. When the temperature of the ironing plate is not higher than a certain minimum temperature, the water flowing into the ironing plate from the reservoir will not be transformed into steam. If the user is not careful, water will flow onto the clothes instead of steam when the steam button is pressed. Even when the ironing plate is hot enough, continuous ironing may lower the temperature of the iron, thereby causing the above-mentioned problem.

2. When a conventional steam iron is tilted forwards too much, water from the reservoir could leak out through the water entry gate positioned in the front of the reservoir.

SUMMARY

A primary objective of the present invention is to provide a means of overcoming the first aforementioned drawback by use of a bi-metallic plate and a special arrangement inside the ironing plate to prevent water from flowing out of the ironing plate and onto the clothes being ironed if the ironing plate is not yet hot enough to form steam.

Another objective of the present invention is to provide a means of overcoming the second aforementioned drawback by use of an elbow-like water entry tube, with one end disposed nearby the water entry gate, and the other end horizontally extending backwards, to prevent water from leaking out when the steam iron is tilted forward too much.

Further objectives and advantages of the present invention will become apparent as the following description proceeds, and the features of novelty which characterize the invention be pointed out with particularity in the claim annexed to and forming a part of this invention.

BRIEF DESCRIPTION OF THE DRAWINGS

FIG. 3-A and 3-B show the reservoir portion of the present invention in two different orientations;

FIG. 4-A and 4-B are prior art which show the reservoir portion of a conventional steam iron in two different orientations;

DETAILED DESCRIPTION OF THE PREFERRED EMBODIMENT

Figure 1:
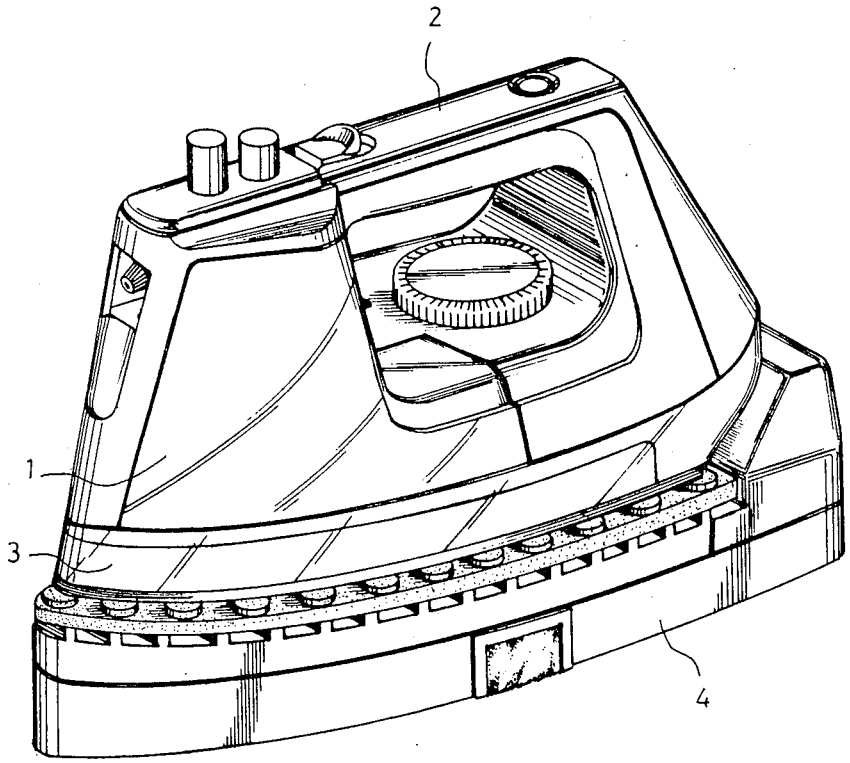
FIG. 1 is a steam iron in which the present invention has been applied.

Referring to the FIG. 1, it can be seen that the present invention comprises a reservoir portion 1, a handle 2, an ironing plate 3 and a base 4. The reservoir portion 1, handle 2 and ironing plate 3 form an operative steam iron. The base 4 not only supports the steam iron but is also able to be used as a movable power supply which enables the steam iron to work without a power cord attached.

Referring to FIG. 3-A and 3-B, it can be seen that the reservoir portion 1 is a hollow body for containing water. A water entry gate 17 is set on the front face of the reservoir portion 1 for filling the reservoir portion 1. A drain plug 10 is located at the bottom of the reservoir. An elbow-like water entry tube 15, with one end connecting nearby the water entry gate 17 and the other end horizontally extending backwards, prevents the water in the reservoir portion 1 from flowing out thereof when the steam iron is tilted (see FIG. 3-B). In comparison with the present invention, the conventional steam iron as shown in FIG. 4-A has a big drawback. The water inside the reservoir will spill out through the water entry gate 41 when the iron is tilted forwards (see FIG. 4-B).

Referring back to FIG. 3-A, it can be seen that a spray button is set on the top face of the reservoir portion 1. The spray button 14 can be used to control the spray nozzle 16 which is positioned directly above the water entry gate 17 to spray mist on the clothes when the spray button is pressed. A steam button 12 for sending water from the reservoir portion 1 to the ironing plate 3 through a water tube 13 is also set on the top face of the reservoir portion 1.

Figure 2:
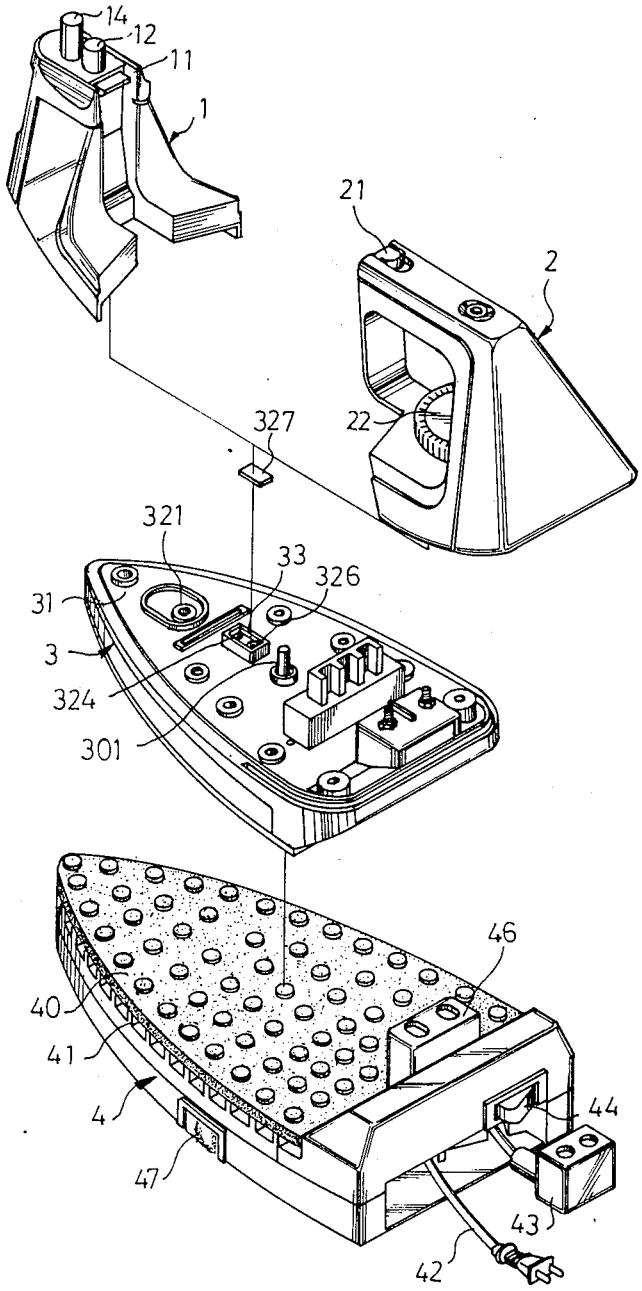
FIG. 2 is an exploded view of the steam iron according to the present invention as shown in FIG. 1.

Referring to FIG. 2, it can be seen that how the handle 2 is attached on the rear portion of the ironing plate 3. The reservoir portion 1 attaches to the front portion of the ironing plate 3 with an engagement between the handle block 11 on the reservoir portion 1 and the release button 21 on the handle 2. A selection dial 22 set on the lower central portion of the handle 2 provides a temperature selection function based on the type of material being ironed.

Figure 5:
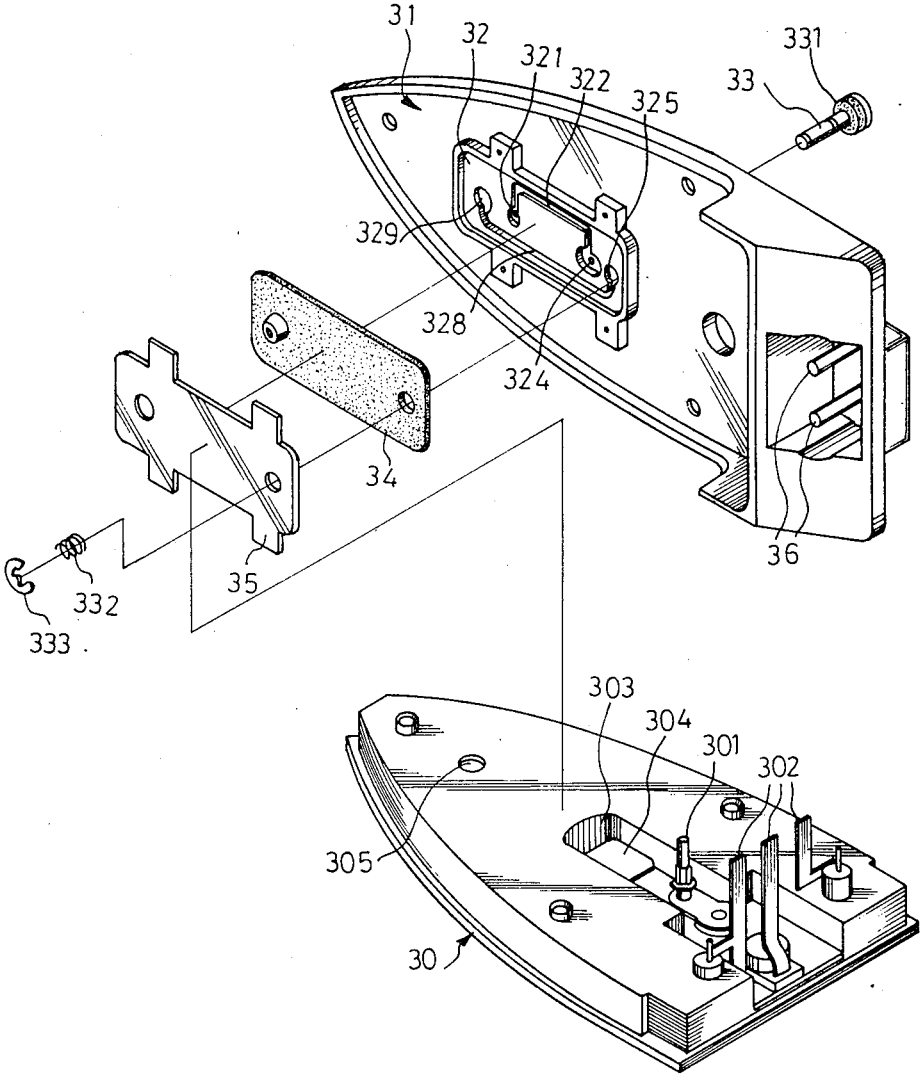
FIG. 5 is an exploded view of the upper plate together with the lower plate.

The ironing plate 3 comprises an upper plate 31 and a lower plate 30 most of which is hollow (FIG. 2 and 5). The upper plate 31 and the lower plate 30 are secured together with fasteners. The top face of the upper plate 31 that is also the top face of the ironing plate 3 is arranged so that both the reservoir portion 1 and the handle 2 can be easily and stably attached thereto.

The front area of the lower plate 30 has a passage hole 305 which allows water into the inner space where water is then heated into steam. Several connecting plates 302 set on the rear side of the lower plate 30 respectively connect to different resistors. A selection switch 301 to which the selection dial 22 on the handle 2 attaches is positioned in the middle of a slot 303 which is formed on the central rear half of said lower plate 30. A bi-metallic plate 304 is set in the front of the slot 303. The bi-metallic plate 304 changes its shape concavely or convexly depending on the surrounding temperatures.

A water circuit housing 32 is set on the inside face of the upper plate 31 (see FIG. 5). Two penetrating holes 321 and 324 are set on opposite ends of the water circuit A on 322. The hole 321 receives water from the water tube 13 (see FIG. 3-A) in the reservoir portion 1, while the hole 324 allows water into the mini-reservoir 326 on the middle top face of the upper plate 31 (see FIG. 2). Therefore, water in the reservoir portion 1 flows to said mini-reservoir 326 on the upper plate 31 through the water circuit A. The top face of the said mini-reservoir 326 is sealed with a plate 327.

Referring to FIG. 5, it can be seen that a plunger's hole 325 for leaking water out of the mini-reservoir 326 (see FIG. 2) is set inside the mini-reservoir 326. Water leaks from the upper plate 31 to the lower plate 30 further by way of water circuit B or 328 and the leak hole 329 on the other end of the water circuit B. A gasket 34 for sealing water circuits A and B is positioned inside the water circuit housing 32. A fixing plate 35 secures the gasket 34 to the water circuit housing 32.

A special arrangement (see FIG. 5), keeping water from flowing into the lower plate 30 when the steam iron according to the present invention is not yet heated to a minimum temperature, comprises aforementioned bi-metallic plate 304 and a plunger 33. The plunger 33 having a seal 331 beneath the head penetrates the plunger's hole 325 inside the mini-reservoir 326, the gasket 34 and the fixing plate 35. The plunger 33 is spring-loaded by spring 332 which is retained by a C-ring 333. Therefore, the plunger 33 normally seals the plunger's hole 325. Further, the lower end of the plunger 33 contacts aforementioned bi-metallic plate 304. When the steam iron is heated over a certain temperature, the bi-metallic plate 304 is deformed convexly upwards, thereby pushing up the plunger 33. The water inside the mini-reservoir 326 thereby leaks out and flows into the lower plate 30. A conventional steam iron does not provide such a novel function. Therefore, when the steam button 12 is pressed down, water stored in the reservoir 1 (not steam) will issue from the ironing plate 3 onto the clothes being ironed if the steam iron is not hot enough. This unpleasant phenomenon does not occur with the steam iron according to the present invention. Further, a plug 36 is also set in the rear portion of inside face of the upper plate 31.

Referring to FIG. 2, it can be seen that a plurality of parallel cooling fins 41 which provide heat dissipation and support the heat-resisting plate 40 are set on the top face of the base 4. There are a plurality of tips together with the plate which further help to dissipate heat. The heat-resisting plate 40 is further set with a rim around its perimeter which engages and secures the cooling fins 41 on the base 4. The plug socket 46 for receiving the plug 36 (see FIG. 5) is set in the rear of the heat-resisting plate 40. Both the extension socket 43 and the power cord 42 are positioned inside the base 4. The extension socket 43 enables the steam iron to reach a further work position after it has been drawn out of the base 4. The power cord 42 is also able to be drawn out of the base 4 to engage with a power socket. The extension socket 43 and the power cord 42 are stored inside the base 4 on separate rotatable plates. The ON/OFF switch 44 is disposed at the rear of the base 4. A hook and loop fastening means or Velcro strip (Trade Mark) 47 is set on both side faces of the base 4. Together with a Velcro band, the Velcro strip secures 5 the steam iron to the base 4 while being transported.

With a view of that the characteristics of a steam iron according to the present invention can be more clearly understood, some important structure and their functions will be pointed out hereinafter.

Referring to FIG. 2, 3-A and 3-B, it can be seen that the novel water entry tube 15, disposed inside the reservoir portion 1 with one end attaching nearby the water entry gate 17 and the other and extending horizontally backwards, prevents the water in the reservoir portion 1 from flowing out through the water entry gate 17 when the steam iron is tilted forwards. When the ironing plate 3 is heated over a certain minimum temperature, the bi-metallic plate 304 (FIG. 5) deforms convexly upwards and meanwhile pushes up the plunger 33 to open the plunger's hole 325. The water stored inside the reservoir portion 1 flows into the mini-reservoir 326 by way of the water circuit A after the steam button 12 has been pressed. With the plunger's hole 325 being already opened in accordance with the thermal deformation of the bi-metallic plate 304, the water inside the mini-reservoir 326 flows out of the mini-reservoir 326 and into the lower plate 30 by way of the water circuit B. The water having flowed into the lower plate 30 will hence be heated into steam for efficiently ironing wrinkled clothes or the like. On the other hand, if the ironing plate 3 has already cooled down or has not yet been heated to the minimum temperature, the bi-metallic plate 304 will hold its original concave shape. The plunger's hole 325 is closed and sealed by the plunger 33 due to the elasticity of the spring 332. In this condition, water is unable to flow into the lower plate 30 even when the steam button 12 is pressed down. Accordingly, the drawback of an ordinary steam iron (i.e. that water will leak onto the surface of clothes or table while the steam button is pressed and the ironing plate is not hot enough), is eliminated with a steam iron according to the present invention.

When the operative steam iron (i.e. sections 1, 2 and 3) is put onto the base 4, the plug 36 would engage with the plug socket 46 and the power will flow into the steam iron by way of the power cord 2 which of course has attached to a power supply. When it gets hot enough, the steam iron can be disengaged from the base 4 and be used to iron without the bother of any attached cords. This makes the work of iron convenient and simple. If necessary, the extension socket 43 can be used along with the plug 36, thereby allowing the steam iron to reach a further work position.

As various possible embodiments might be made of the above-invention without departing from the scope of the invention, it is to be understood that all matter herein described or shown in the accompanying drawings is to be interpreted as illustrative and not in a limiting sense. Thus it will be appreciated that the drawings are exemplary of a preferred embodiment of the invention.

I claim:

1. An improved steam iron comprising:

(a) a reservoir portion, said reservoir portion having a hollow housing including a water entry gate on the front face thereof, a spray nozzle set within said entry gate, a spray button and a steam button both set on the top section thereof, a water tube attached to said steam button and an elbow-like water entry tube with one end thereof attaching nearby said water entry gate and the other end thereof horizontally extending backwards;

(b) an ironing plate, said ironing plate comprising a lower plate and an upper plate, said lower plate being for the most part hollow and having a passage hole on the front area thereof, several connecting plates being set on the rear end of said lower plate and a slot being set on the central rear half of said lower plate, a selection switch being set within said slot and a bi-metallic plate being set beside said selection switch, the top face of said upper plate being set with a mini-reservoir, the inside face of said upper plate being set with a water circuit housing, water circuits A and B being set within said housing, water from said reservoir portion flowing into said mini-reservoir through said water circuit A, a plunger's hole being set inside said mini-reservoir together with said water circuit B enabling water to flow out of said mini-reservoir into said lower plate, a gasket and a fixing plate being secured to said housing, a plunger through said mini-reservoir and said plunger's hole being secured with a C-ring and contacting said bi-metallic plate with one end thereof, a plug being set on the rear end of said lower plate;

(c) a handle, said handle attaching onto a handle block on the rear half of said ironing plate and being set with a selection dial on the central portion thereof, a release button being set on the top front end of said handle, said reservoir portion engaging said handle with said handle block, said release button being used to disengage said reservoir portion and said handle; and (d) a base having side faces, the top face of said base having a plurality of parallel cooling fins, a heat-resisting plate which has a plurality of tips being set on said cooling fins, a plug socket being set on the rear portion of said base, a power cord and an extension socket stored inside said base, an ON/-OFF switch being disposed at the rear of said base, a hook and loop fastening means being set on each of the side faces of said base.

* * * * *